US007648582B2

(12) United States Patent
Steger

(10) Patent No.: US 7,648,582 B2
(45) Date of Patent: Jan. 19, 2010

(54) CLEANING OF ELECTROSTATIC CHUCKS USING ULTRASONIC AGITATION AND APPLIED ELECTRIC FIELDS

(75) Inventor: Robert J. Steger, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 614 days.

(21) Appl. No.: 11/315,272

(22) Filed: Dec. 23, 2005

(65) Prior Publication Data

US 2007/0144554 A1 Jun. 28, 2007

(51) Int. Cl.
*B08B 3/12* (2006.01)

(52) U.S. Cl. ..... 134/1; 134/2

(58) Field of Classification Search ..... 134/1, 134/26, 1.3, 2; 361/234
See application file for complete search history.

(56) References Cited

U.S. PATENT DOCUMENTS 5,187,865 A * 2/1993 Dolin, Jr. ..... 29/868
5,507,874 A 4/1996 Su et al.
5,762,748 A * 6/1998 Banholzer et al. ..... 156/345.1
5,783,790 A * 7/1998 Mitsumori et al. ..... 204/157.15
5,846,595 A * 12/1998 Sun et al. ..... 427/2.14
6,166,432 A * 12/2000 Ohno et al. ..... 257/701
6,352,081 B1 * 3/2002 Lu et al. ..... 134/22.1
6,391,118 B2 * 5/2002 Fujii et al. ..... 134/1
6,491,571 B1 12/2002 Ohno et al.
6,770,211 B2 * 8/2004 DeBar et al. ..... 216/27
6,841,008 B1 1/2005 Branco et al.
6,863,740 B2 3/2005 Moriyama et al.
7,052,553 B1 * 5/2006 Shih et al. ..... 134/1
2002/0153024 A1 10/2002 Akiba
2003/0029843 A1 * 2/2003 Barbulescu ..... 219/69.14
2003/0080333 A1 5/2003 Yamaguchi et al.
2003/0090070 A1 * 5/2003 Endou et al. ..... 279/128
2003/0172952 A1 9/2003 Takase et al.
2003/0180459 A1 * 9/2003 Redeker et al. ..... 427/248.1
2004/0045574 A1 3/2004 Tan
2004/0060579 A1 4/2004 Kim et al.
2004/0226654 A1 * 11/2004 Hongo et al. ..... 156/345.11
2004/0231706 A1 * 11/2004 Bhatnagar et al. ..... 134/28
2007/0163624 A1 * 7/2007 Kumar et al. ..... 134/42

FOREIGN PATENT DOCUMENTS

WO WO 03/061859 A1 7/2003

OTHER PUBLICATIONS

International Search Report and Written Opinion dated Apr. 2, 2008 for PCT/US06/47183.
International Preliminary Report on Patentability dated Jun. 24, 2008 for PCT/US2006/047183.
International Examination Report dated May 28, 2009 for Austrian Patent Application No. 200804356-4.

* cited by examiner

*Primary Examiner*—Michael Kornakov
*Assistant Examiner*—Naomi Birbach
(74) *Attorney, Agent, or Firm*—Buchanan Ingersoll & Rooney PC

(57) ABSTRACT

A method of cleaning an ESC comprises immersing a ceramic surface of the ESC in dielectric fluid; spacing the ceramic surface of the ESC apart from a conductive surface such that the dielectric fluid fills a gap between the ceramic surface of the ESC and the conductive surface; and subjecting the dielectric fluid to ultrasonic agitation while simultaneously applying voltage to the ESC.

19 Claims, 1 Drawing Sheet

Figure
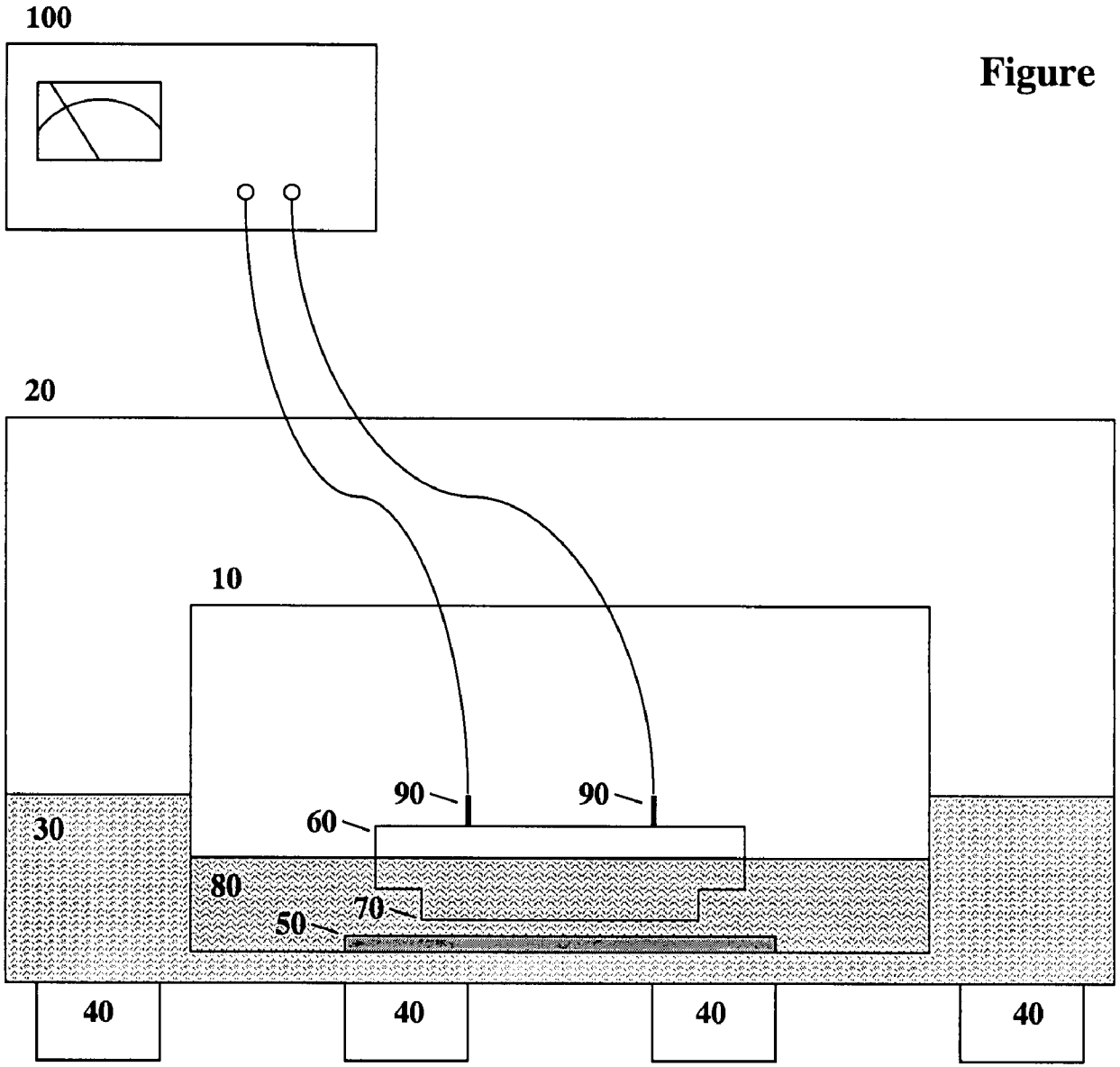

CLEANING OF ELECTROSTATIC CHUCKS USING ULTRASONIC AGITATION AND APPLIED ELECTRIC FIELDS

BACKGROUND

An electrostatic chuck (ESC), a component of semiconductor processing equipment such as plasma etch chambers, can be used for transporting, holding and/or temperature control of a semiconductor wafer or glass substrate (i.e., flat panel display) during processing, for example, in a chemical vapor deposition, physical vapor deposition, or etch reactor. ESCs often exhibit short lifetimes resulting in failures including, for example, dynamic alignment failure, high leakage of helium cooling gas between the ESC and the underside of a supported substrate, increased dechucking time, and sticking of the substrate to the ESC or dechucking failure. The early failure of ESCs can cause substrate breakage, impact throughput, lead to particle and defect issues, and increase ownership costs of plasma processing equipment incorporating such ESCs.

SUMMARY

Provided is a method of cleaning an ESC comprising immersing a ceramic surface of the ESC in dielectric fluid. The ceramic surface of the ESC is spaced apart from a conductive surface such that the dielectric fluid fills a gap between the ceramic surface of the ESC and the conductive surface. The dielectric fluid is subjected to ultrasonic agitation while simultaneously applying voltage to the ESC.

BRIEF DESCRIPTION OF THE DRAWING

The FIGURE shows an exemplary configuration for cleaning an ESC as described herein.

DETAILED DESCRIPTION

Contaminants are deposited on ceramic ESC surfaces during etching. The contaminants change the surface characteristics of the ESCs and cause early failure, as ESC performance greatly depends on the cleanliness of ESC surfaces. Organic impurities, metallic impurities, fluoride impurities, electrode impurities, silicon particles, surface particles, and combinations thereof are deposited on ESC surfaces during dielectric plasma etching, as well as during manufacture of new ESCs. Such fluoride impurities include, for example, aluminum fluoride, titanium fluoride, and combinations thereof; such metallic impurities include, for example, iron, chromium, nickel, molybdenum, vanadium, and combinations thereof; such electrode impurities include, for example, tungsten; and such silicon particles include, for example, Si, $SiO_2$, and combinations thereof. It has been surprisingly discovered that new ESCs can be preconditioned and used ESCs can be recovered by cleaning the contaminants resulting from manufacturing or deposited on the ESCs during etching to refresh the ceramic surface by means of the disclosed cleaning process.

As used herein, dielectric ESCs refer to ESCs used in dielectric etch processes such as plasma etching silicon oxide and low-k materials. An exemplary dielectric ESC can comprise a metal base (e.g., anodized or non-anodized aluminum alloy) with a ceramic surface on which a semiconductor or substrate such as a wafer is supported. As an example, the ceramic surface may comprise a sintered laminate comprising a patterned refractory (e.g., tungsten or molybdenum) electrode between two ceramic layers (e.g., thin ceramic layers approximately 20 mils thick). The laminate may be bonded to the metal base with a bonding material such as a silicone based material containing conductive powders (e.g., aluminum, silicon, or the like). The metal base, approximately 1.5 inches thick, typically includes RF and DC power feeds, through holes for lift pins, helium gas passages, channels for temperature controlled fluid circulation, temperature sensing arrangements, and the like.

ESCs are typically either Coulombic or Johnsen-Rahbek type. Coulombic type ESCs use a dielectric surface layer having a higher electrical resistance to generate coulombic electrostatic forces. Johnsen-Rahbek type ESCs, which often provide higher electrostatic clamping forces for a lower applied voltage, utilize lower resistance dielectric surface layers such as $Al_2O_3$ doped with, for example, $TiO_2$.

According to an embodiment, the ceramic dielectric layer of a Johnsen-Rahbek type ESC may comprise 94% $Al_2O_3$, 4% $SiO_2$, 1% $TiO_2$, and 1% CaO, as well as trace amounts of MgO, Si, Ti, Ca, and Mg. According to another embodiment, for a Coulombic type ESC, the ceramic dielectric layer may comprise greater than or equal to 99% $Al_2O_3$. Thus, depending on the composition of the ceramic layer, elements such as Ti, Si, Mg, and Ca may not be considered contaminants to be removed by the disclosed cleaning process. In contrast, contaminants such as metal particles and electrode particles (e.g., tungsten or molybdenum) are preferably removed from the surface of the ESC by the disclosed cleaning process.

Contaminants such as, for example, organic impurities, metallic impurities, and electrode impurities may be found on new ESCs while contaminants such as, for example, organic impurities, fluoride impurities, and silicon particles, may be deposited on the ceramic surface of used ESCs during dielectric etching.

Provided is a method of cleaning an ESC comprising immersing a ceramic surface of the ESC in dielectric fluid; spacing the ceramic surface of the ESC apart from a conductive surface such that the dielectric fluid fills a gap between the ceramic surface of the ESC and the conductive surface; and subjecting the dielectric fluid to ultrasonic agitation while simultaneously applying voltage to the ESC.

Preferably 25-200 W/gallon of ultrasonic power is applied to the dielectric fluid. The dielectric fluid is subjected to ultrasonic agitation while simultaneously applying voltage to the ESC preferably for 15-120 minutes. The voltage may be a direct current of, for example, 125-500 V, which preferably is reversed, or the voltage may be an alternating current of, for example, 30-90 Hz, preferably approximately 60 Hz. The ceramic surface of the ESC is preferably spaced 5-200 μm, more preferably approximately 25 μm, apart from the conductive surface and application of the voltage preferably produces an electric field of 10-15 MV/m in the gap between the ceramic surface of the ESC and the conductive surface. The conductive surface is preferably larger than the ESC in lateral dimensions, and preferably flat, so as to produce a uniform electric field in the gap between the ceramic surface of the ESC and the conductive surface.

The method may further comprise suspending at least the ceramic surface of the ESC in deionized water and subjecting the water to ultrasonic agitation, rinsing the ESC with deionized water, and/or baking the ESC, preferably at approximately 120° C. for 1 hour. The ESC is preferably cleaned with the ceramic surface of the ESC facing downward. The method preferably removes contaminant particles from the ceramic surface of the ESC. In particular, the method has been found most effective in removing contaminant particles having average diameters that are less than the spacing of the ceramic surface of the ESC apart from the conductive surface from the ceramic surface of the ESC, and specifically, contaminant particles having average diameters of approximately 5-10 μm from the ceramic surface of the ESC. Smaller contaminant particles may also be removed from the ceramic surface of the ESC.

EXAMPLE

The following cleaning process, which can be used to clean new and used ESCs, is provided to be illustrative, but not limiting. In order to establish a baseline for determining the effectiveness of the cleaning process, prior to cleaning, two silicon wafers are electrostatically clamped on an ESC without etching the wafers. The ESC was previously used for clamping wafers during dielectric etching. Since the ESC is used, the ceramic surface of the ESC had been exposed to plasma. As a result, the ceramic surface of the ESC had become highly contaminated with contaminant particles, which are to be removed by cleaning.

With reference to the FIGURE, in order to reduce the amount of dielectric fluid to be used in the cleaning process, a plastic tank 10 can be placed within an ultrasonic tank 20 containing approximately 4.7 gallons of deionized water 30, such that there is deionized water between the two tanks. The ultrasonic tank 20 is typically stainless steel and has ultrasonic transducers 40 (whose power supply is not shown). A conductive metal plate 50, larger than the ESC 60 in lateral dimensions and approximately 0.5" thick, can be placed in the bottom of the plastic tank 10. Alternatively, a conductive tank having a flat bottom surface can be used in place of the plastic tank 10 containing a conductive metal plate 50 at its bottom. Strips of tape (not shown), approximately 25 μm thick, are applied to the conductive metal plate 50. Thus, the strips of tape, present at the periphery of the ESC 60, act as spacers that space the conductive metal plate 50 apart from the ceramic surface 70 of the ESC 60, which is placed facing downward in the plastic tank 10 such that the ceramic surface 70 of the ESC 60 is above the conductive metal plate 50. If desired, the ESC 60 can be suspended in order to space the ceramic surface 70 of the ESC 60 apart from the conductive metal plate 50.

Approximately 1.5" of a dielectric fluid 80, such as, for example, FLUOROINERT™, sold by 3M™, St. Paul, Minn., is added the plastic tank 10, so as to cover the ceramic surface 70 of the ESC 60, while keeping the ESC electrodes 90 out of the dielectric fluid 80. As the plastic tank 10 within the ultrasonic tank 20 is used in order to reduce the amount of dielectric fluid 80, the plastic tank 10 can be omitted and the dielectric fluid 80 can instead be placed directly into an ultrasonic tank having a conductive, preferably flat, bottom surface, or into an ultrasonic tank with a conductive metal plate placed at its bottom A DC potential of 250 V is applied by way of a high voltage supply 100 to the ESC electrodes 90 and approximately 300 W of ultrasonic power is applied to the water, which corresponds to approximately 64 W/gallon. After approximately thirty minutes, the voltage to the ESC electrodes 90 is reversed. After approximately another thirty minutes, the voltage to the ESC electrodes 90 is disconnected, the ultrasonic power is turned off, the plastic tank 10 is removed from the ultrasonic tank 20, and the ceramic surface 70 of the ESC 60 is suspended in the water of the ultrasonic tank 20 with a gap of approximately 1" from the bottom of the ultrasonic tank 20, again with the ceramic surface 70 of the ESC 60 facing downward. Approximately 300 W of ultrasonic power can be applied to the water for approximately thirty minutes. The ESC is rinsed in deionized water and baked at 120° C. for 1 hour.

While various embodiments have been described, it is to be understood that variations and modifications may be resorted to as will be apparent to those skilled in the art. Such variations and modifications are to be considered within the purview and scope of the claims appended hereto.

What is claimed is:

1. A method of cleaning an electrostatic chuck comprising:

immersing a ceramic surface of the electrostatic chuck in dielectric liquid with the ceramic surface facing downward and with a portion of the electrostatic chuck above an upper surface of the dielectric liquid;

spacing the ceramic surface of the electrostatic chuck apart from an electrically isolated conductive surface such that the dielectric liquid fills a gap between the ceramic surface of the electrostatic chuck and the conductive surface; and subjecting the dielectric liquid to ultrasonic agitation while simultaneously applying voltage to the electrostatic chuck.

2. The method of claim 1, comprising subjecting the dielectric liquid to ultrasonic agitation while simultaneously applying the voltage to the electrostatic chuck for 15-120 minutes.

3. The method of claim 1, wherein the applying voltage comprises applying a direct current voltage to the electrostatic chuck.

4. The method of claim 3, wherein the applying voltage comprises applying a direct current voltage of 125-500 V to the electrostatic chuck.

5. The method of claim 3, wherein the applying voltage comprises reversing the direct current voltage applied to the electrostatic chuck.

6. The method of claim 1, wherein the applying voltage comprises applying an alternating current voltage to the electrostatic chuck.

7. The method of claim 1, wherein the applying voltage comprises producing an electric field of 10-15 MV/m by applying voltage to the electrostatic chuck.

8. The method of claim 1, wherein the subjecting the dielectric liquid to ultrasonic agitation while simultaneously applying voltage to the electrostatic chuck is effective in removing contaminant particles from the ceramic surface of the electrostatic chuck.

9. The method of claim 1, wherein the subjecting the dielectric liquid to ultrasonic agitation while simultaneously applying voltage to the electrostatic chuck is effective in removing contaminant particles having average diameters of approximately 5-10 μm from the ceramic surface of the electrostatic chuck.

10. The method of claim 1, wherein the subjecting the dielectric liquid to ultrasonic agitation comprises applying 25-200 W/gallon of ultrasonic power to the dielectric liquid.

11. The method of claim 1, further comprising:

removing the electrostatic chuck from the dielectric fluid and suspending at least the ceramic surface of the electrostatic chuck in deionized water; and subjecting the water to ultrasonic agitation.

12. The method of claim 1, further comprising removing the electrostatic chuck from the dielectric liquid and rinsing the electrostatic chuck with deionized water.

13. The method of claim 1, further comprising removing the electrostatic chuck from the dielectric fluid and baking the electrostatic chuck.

14. The method of claim 1, wherein the spacing comprises spacing the ceramic surface of the electrostatic chuck 5-200 μm apart from the conductive surface.

15. The method of claim 1, wherein the spacing comprises spacing the ceramic surface of the electrostatic chuck approximately 25 μm apart from the conductive surface.

16. The method of claim 1, wherein the conductive surface is flat.

17. A method of cleaning an electrostatic chuck comprising:

immersing a ceramic surface of the electrostatic chuck in dielectric fluid with the ceramic surface facing downward and with a portion of the electrostatic chuck above an upper surface of the dielectric fluid;

spacing the ceramic surface of the electrostatic chuck apart from a conductive surface such that the dielectric fluid fills a gap between the ceramic surface of the electrostatic chuck and the conductive surface; and subjecting the dielectric fluid to ultrasonic agitation while simultaneously applying voltage to the electrostatic chuck;

wherein the immersing comprises immersing the ceramic surface in the dielectric fluid within a plastic tank, wherein the plastic tank is within an ultrasonic tank at least partially filled with deionized water; and wherein the conductive surface is located in the bottom of the plastic tank and the ceramic surface is placed on strips of tape which act as spacers at the periphery of the electrostatic chuck.

18. The method of claim 17, wherein the applying voltage comprises applying an alternating current voltage at a frequency of approximately 60 Hz to the electrostatic chuck.

19. A method of cleaning an electrostatic chuck comprising:

immersing a ceramic surface of the electrostatic chuck in dielectric liquid with the ceramic surface facing downward and with a portion of the electrostatic chuck above an upper surface of the dielectric liquid;

spacing the ceramic surface of the electrostatic chuck apart from an electrically isolated conductive surface such that the dielectric liquid fills a gap between the ceramic surface of the electrostatic chuck and the conductive surface; and subjecting the dielectric liquid to ultrasonic agitation while simultaneously applying voltage to the electrostatic chuck, wherein the electrically isolated conductive surface comprises a plate which is larger than the ceramic surface of the electrostatic chuck in lateral dimensions.

* * * * *